US007455272B2

(12) United States Patent
Monti

(10) Patent No.: US 7,455,272 B2
(45) Date of Patent: Nov. 25, 2008

(54) FRAMELESS COMPRESSION COMPONENT MOUNTS AND QUICK RELEASE SPEAKER FRAMES

(75) Inventor: Daniel John Monti, Forest Hills, NY (US)

(73) Assignee: Architectural Audio/Video, Forest Hills, NY (US)

( * ) Notice: Subject to any disclaimer, the term of this patent is extended or adjusted under 35 U.S.C. 154(b) by 0 days.

(21) Appl. No.: 11/517,263

(22) Filed: Sep. 8, 2006

(65) Prior Publication Data

US 2007/0051862 A1 Mar. 8, 2007

Related U.S. Application Data

(60) Provisional application No. 60/715,223, filed on Sep. 8, 2005.

(51) Int. Cl.
*A47F 5/00* (2006.01)

(52) U.S. Cl. ..... 248/309.1

(58) Field of Classification Search ..... 249/309.1, 249/314, 27.1, 27.3, 309.2, 466, 475.1; 381/87, 381/332, 333, 334, 335, 336, 386, 391; 181/150
See application file for complete search history.

(56) References Cited

U.S. PATENT DOCUMENTS

| | | | | |
|---|---|---|---|---|
| 1,484,001 | A | | 2/1924 | Ainsworth |
| 4,222,093 | A | | 9/1980 | Garcia et al. |
| 4,244,096 | A | | 1/1981 | Kashichi |
| 4,389,824 | A | | 6/1983 | Anderson |
| 4,407,100 | A | | 10/1983 | Huelsekopf |
| 4,434,710 | A | | 3/1984 | Bolton et al. |
| 4,635,168 | A | | 1/1987 | Crowley |
| 4,688,596 | A | | 8/1987 | Liebmann et al. |
| 4,726,152 | A | | 2/1988 | Vagedes et al. |
| 4,778,134 | A | | 10/1988 | Struthers et al. |
| 4,815,558 | A | | 3/1989 | Krainhofer |
| 4,853,966 | A | | 8/1989 | Skrzycki |
| 4,920,708 | A | | 5/1990 | MacLeod et al. |
| 4,928,914 | A | * | 5/1990 | Snodell ..... 248/284.1 |
| 4,993,511 | A | | 2/1991 | Hiraki et al. |
| 5,082,083 | A | | 1/1992 | Draffen |
| 5,143,339 | A | | 9/1992 | Ashcraft et al. |
| 5,221,069 | A | | 6/1993 | Struthers et al. |
| 5,292,092 | A | | 3/1994 | Curtis et al. |
| 5,310,149 | A | | 5/1994 | Struthers et al. |
| 5,397,093 | A | * | 3/1995 | Chubb et al. ..... 248/544 |
| 5,423,500 | A | | 6/1995 | Struthers et al. |
| 5,577,702 | A | | 11/1996 | Chubb et al. |

(Continued)

*Primary Examiner*—Ramon O Ramirez
(74) *Attorney, Agent, or Firm*—Nath Law Group; Jerald L. Meyer; Derek Richmond

(57) ABSTRACT

A mount for mounting a component within an opening of a substantially planar body includes a front bracket having at least one attachment wing that attaches to a first surface of the body. The attachment wing is substantially coplanar with the plane of the body. The mount also includes a back plate secured to the component, and at least one connector connecting the front bracket to the back plate. A component-and-frame combination includes a component having a perimeter edge and at least one protrusion on the perimeter edge, and a frame has an inside surface facing a center of a framed space. The frame has at least one indentation of the inside surface corresponding in position to the protrusion. The protrusion and the indentation are shaped to allow the component to be inserted into the frame from only a first side of the frame, and to allow the component to be removed from the frame from only a second side of the frame.

10 Claims, 13 Drawing Sheets

U.S. PATENT DOCUMENTS

| | | | | |
|---|---|---|---|---|
| 5,586,933 | A | 12/1996 | Sawyer et al. | |
| 5,771,647 | A | 6/1998 | Kempen et al. | |
| 5,893,235 | A | 4/1999 | Almond | |
| 5,952,619 | A | 9/1999 | Kantor et al. | |
| 6,074,450 | A | 6/2000 | Raber | |
| 6,192,640 | B1 | 2/2001 | Snyder | |
| 6,193,200 | B1 * | 2/2001 | Kao | 248/309.1 |
| 6,550,570 | B2 | 4/2003 | Combest | |
| 6,601,356 | B2 | 8/2003 | Snyder | |
| 6,685,332 | B1 | 2/2004 | Clark | |
| 6,766,027 | B2 | 7/2004 | Ryan et al. | |
| 2005/0092890 | A1 * | 5/2005 | Liao | 248/466 |

* cited by examiner

FRAMELESS COMPRESSION COMPONENT MOUNTS AND QUICK RELEASE SPEAKER FRAMES

This application claims the benefit of U.S. Provisional Application No. 60/715,223 filed Sep. 8, 2005. The aforementioned provisional application's disclosure is incorporated herein by reference in its entirety.

BACKGROUND OF THE INVENTION

Mounting of HVAC grills, flush lamps, high quality speakers, and other components in the ceiling or in walls has increased dramatically over the last thirty years. Unfortunately, these components are somewhat bulky and cumbersome. Thus, the mounting of in-wall components is an expensive enterprise, particularly since brackets to accommodate such mounting must typically be custom-made. Frequently, considerable effort is associated with the use of such brackets.

The effort required to mount in-wall components is of concern both in new construction and retrofit installations. In new construction installations a bracket is attached to the wall frame or studs of the wall prior to the application of a wall surface. In retrofit mounting installations a bracket is used to mount the speaker in a pre-existing wall, i.e., wherein the wall covering has already been applied. In such retrofit applications, an opening is typically formed within the wall covering and the bracket is then inserted through the opening and attached to the wall covering and/or studs disposed within the wall. As will be appreciated, both new installations and retrofit installation of components are difficult and time consuming processes.

Prior art mounts utilizing wings for attaching the bracket to the framing members are known. Such prior art mounts provide a substantial improvement over the use of custom brackets. However, the use of prior art mounts which incorporate such wings requires that the framing members or studs to which the wings are attached be notched or mortised in order to accommodate the thickness of the wings such that the wallboard applied thereover does not bulge or bow outwardly due to the thickness of wings disposed intermediate the studs and the wall covering.

Prior art mounts which do not contact framing members or studs often rely on a prefabricated decorative frame or flange for support at the face of the wall. Such designs are extremely inconvenient, as the decorative frame or flange may be aesthetically inappropriate, may increase the shipping costs for the bracket, may render the bracket useless if the decorative frame becomes cracked or chipped, and may damage the wall. There is a great need for a mount for the in-wall mounting of components which does not require contact with framing members or studs, and does not require a decorative frame or flange for support.

Prior art support frames often attach to a component with screws, where components may be inserted from either side and the support frame is held in place with a decorative frame or flange at the front. These support frames require excessive labor to unscrew and replace the component, and often provide an insecure and potentially unaligned mount which presents a danger of falling on both sides of the bracket. There is a great need for a support frame in which a component may be mounted to a support frame with minimal need for screws, toggles, or clips. This bracket may allow the component to be inserted from only one side, and allow it to be removed from the opposite side, with easy alignment.

SUMMARY OF THE INVENTIVE ASPECTS

The present inventive subject matter relates to a mount for mounting a component within an opening of a substantially planar body. The mount includes a front bracket having at least one attachment wing that attaches to a first surface of the body. The attachment wing is substantially coplanar with the plane of the body. The mount also includes a back plate secured to the component, and at least one connector connecting the front bracket to the back plate.

In some embodiments, the back plate is open at its center, the component is secured to the back plate through its center, and the back plate is sufficiently shaped to prevent the component from passing through the center.

In some embodiments, the attachment wing is perforated, and the attachment wing is attached to the first surface of the body with an attachment compound.

In some embodiments, the connector is a tensioner which creates a tension between the front bracket and the back plate.

In some embodiments, the front bracket further includes at least one inner wing substantially perpendicular to the plane of the body and extending into the opening, and the attachment wing and inner wing form an angle of no more than 90 degrees.

In some embodiments, the component includes a speaker and a speaker board.

In some embodiments, the substantially planar body is a door, wall, or ceiling; and, the substantially planar body includes drywall, plaster, sheet rock, wood, wood paneling, wallboard, metal, and/or plastic.

In some embodiments, the connectors are tie-wraps; metal tabs; metal clips; cable ties; rapid fasteners; strap wraps; mated gear wrap and ratchet; screws; nut-and-bolt; or drywall screws.

The present inventive subject matter also relates to a method of installing a component in an opening of a substantially planar body. The method includes attaching a front bracket to a first surface of the body by at least one attachment wing substantially coplanar with the plane of the body, attaching a back plate to the front bracket by at least one connector, installing the component in the opening; and attaching the component to the back plate.

In some embodiments, the method also includes attaching the attachment wing to the first surface of the body with an attachment compound.

The present inventive subject matter also relates to a system for installing a component in an opening of a substantially planar body. The system includes means for attaching a front bracket to a first surface of the body, means for attaching a back plate to the front bracket, and means for attaching the component to the back plate.

The present inventive subject matter also relates to a component-and-frame combination. The combination includes a component and a frame. The component has a perimeter edge and at least one protrusion on the perimeter edge. The frame has an inside surface facing a center of a framed space, and at least one indentation of the inside surface corresponding in position to the protrusion. The protrusion and the indentation are shaped to allow the component to be inserted into the frame from only a first side of the frame, and to allow the component to be removed from the frame from only a second side of the frame.

In some embodiments, the component includes a speaker plate and a speaker, and the protrusion is disposed on an edge of the speaker plate.

In some embodiments, the frame includes at least one ratchet within each of the indentations. The ratchet prevents the component from being removed from the first side of the frame.

In some embodiments, the indentations are sufficiently shaped to prevent the component from being inserted from the second side of said frame.

In some embodiments, the combination further includes a channel between the component and the frame, and a grill secured within the channel.

In some embodiments, the indentation is deeper at an end toward the second side of the frame than at an end toward the first side of the frame.

In some embodiments, the component has more than one protrusion, and is aligned in the frame by the placement of one of the protrusions in the indentation.

In some embodiments, the frame comprises more than one indentation, and the component is aligned in the frame by the placement of the protrusion in one of the indentations.

The present inventive subject matter also relates to a method for installing a component-and-frame combination. The method includes installing a frame in a substantially planar body. The frame has an inside surface facing a center of a framed space and at least one indentation at a point on the inside surface. The indentation is shaped to allow the component to be inserted into the frame from only a first side of the frame and to allow the component to be removed from the frame from only a second side of the frame. The method also includes installing the component in the frame. The component has a perimeter edge and at least one protrusion at a point corresponding in position to the indentation. The method also includes placing the protrusion within the indentation.

BRIEF DESCRIPTION OF THE FIGURES

In the detailed description of the invention presented below, reference is made to the accompanying drawings in which.

DETAILED DESCRIPTION OF THE INVENTION

In the following detailed description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and logical changes may be made without departing from the scope of the present invention. The following detailed description, therefore, is not to be taken in a limiting sense, and the scope of the present invention is defined by the appended claims.

Figure 1:
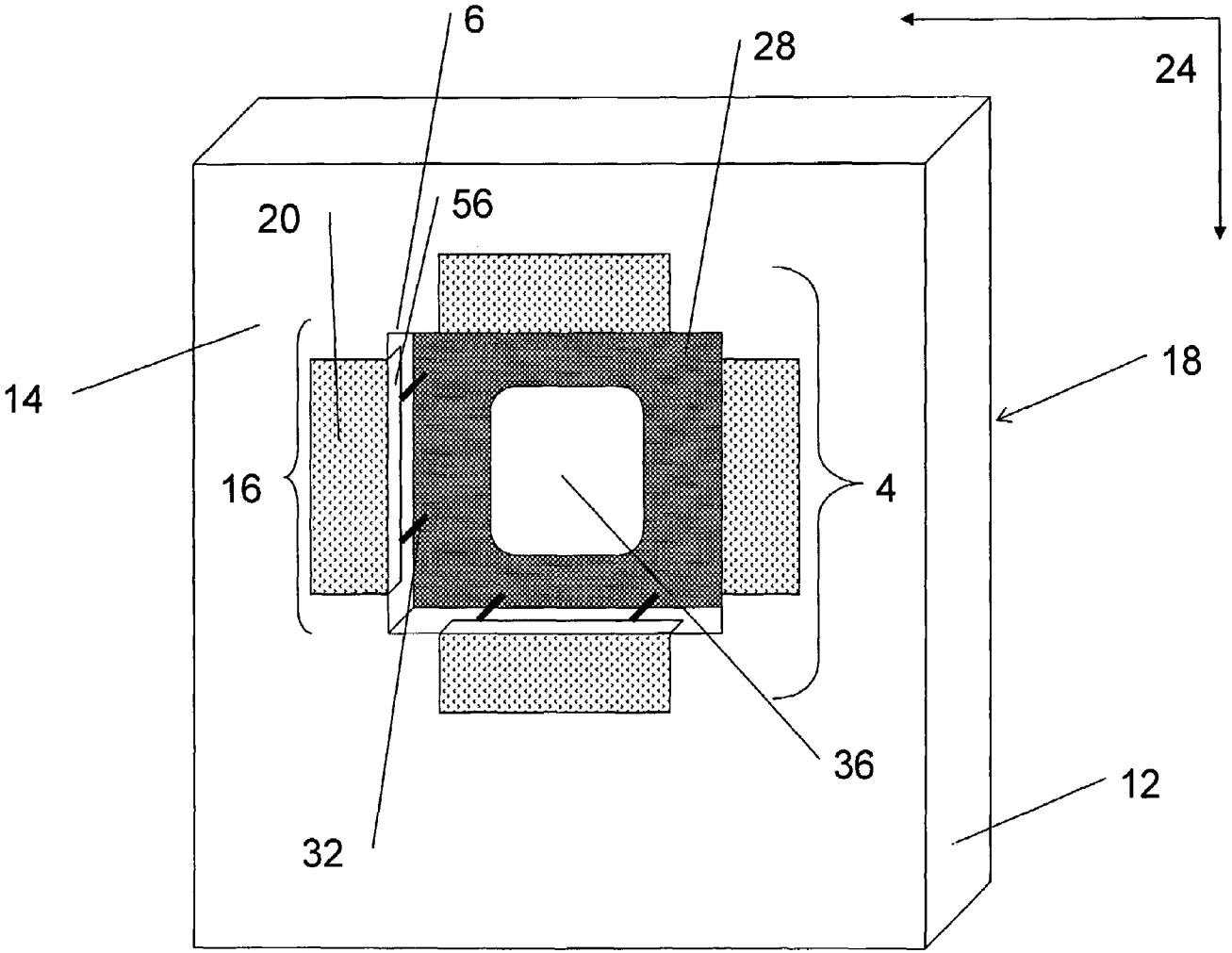
FIG. 1 shows a front view of a first embodiment of a mount according to the present application, with no component present.

FIG. 1 shows a mount 4 disposed at an opening 6 of a substantially planar body 12. As non-limiting examples, the body 12 can be a door, wall, ceiling, or any other substantially planar structure. The body 12 may only be substantially planar on one side, or may have multiple planar sides. The body 12 may be thick or thin. The body 12 may be made of drywall, plaster, sheet rock, wood, wood paneling, wallboard, metal, plastic, or combinations thereof. The body 12 has a first surface 14 and on its opposite side a second surface 18. In FIG. 1, the first surface 14 is visible, while the second surface 18 is not. The body 12 has an opening 6, which as a non-limiting example may be square as in FIG. 1, but may also be rectangular, circular, oval, oblong, triangular, free-form, or any other shape, including shapes which match a dimension of the component.

The mount 4 includes at least one front bracket 16. Although four separate front brackets 16 are shown in FIG. 1 as a non-limiting example, a single continuous bracket can extend across all of the sides of an opening. Such a square bracket, with each side having an L- or V-shaped cross section, may be advantageously form fit to the shape of the opening. Each bracket 16 may be shaped like a trim ring, or any other advantageous shape. The mount 4 may attach at only one side of the opening 6, or may have a contiguous square shape and attach at all four sides. At least one bracket 16 has one or more attachment wings 20. The wing 20 is in contact with the first surface 14 of the body 12, and is substantially coplanar with the plane 24 of the body 12. In FIG. 1 the body 12 and wing 20 are flat and flush. However, the term "coplanar" should be construed to imply that the first surface 14 of the body 12 has substantially the same curvature as the wing 20. Accordingly, as further non-limiting examples, a curved wing 20 can be in contact with a curved surface 14, and an angled wing 20 can be in contact with a matching angled surface at the surface 14 of the body.

The wing 20 may be attached to the first surface 14 of the body 12. Many different ways of attaching may be used. As non-limiting examples, the wing 20 may be screwed, nailed, stapled, stuck, glued, taped, heat-cured, laser-cured, or adhered to the first surface 14 of the body 12, or may be partially or wholly embedded in the body 12.

Importantly, the wing 20 may attach to the first surface 14 of the body 12 by tension alone, as provided by the back plate 28 and connectors 32 (as discussed in detail below). This tension can hold the mount in place indefinitely, and can provide complete support for a component 8 if desired.

Alternately, such tension can hold the mount in place until such time as the attachment wing 20 may be further attached to the first surface 14 of the body 12 with an attaching method as set forth above, or with attachment compound 48. "Attachment compound" refers to any compound which would attach the wing 20 to the first surface 14, and does not imply that the compound has any intrinsic adhesive property. As a non-limiting example, drywall compound (latex-based or non-latex based) or other wall materials may be used as attachment compounds 48 to attach the wing 20 to the first surface 14. As a non-limiting example of timing, the mount 4 may be installed and left in an opening, held in place by the tension it creates. At some later time, an attachment compound 48 may be placed over the attachment wings 20. At a still later time, often toward the end of an installation, a component 8 may be secured within the mount 4.

The mount 4 also includes a back plate 28 disposed at the second surface 18 of the body 12, where the component 8 may be secured (although no component is shown in FIG. 1). The back plate 28 may be any shape or size, and may be made of any material. The back plate 28 may be sufficiently shaped to keep from passing through the opening 6, or may include arms, cables, or any other accessory or extension used to keep from passing through the opening 6. The term "plate" here means not only substantially planar bodies, but bodies of any shape. Here, as a non-limiting example, the back plate 28 is open at its center 36, although other back plates 28 need not have any opening, or may have multiple openings.

The mount 4 also includes at least one connector 32 connecting the front bracket 16 to the back plate 28. In FIG. 1, each of the four front brackets 16 is connected to the back plate 28 by two connectors 32. The connectors 32 hold the back plate 28 in place by securing it to the front bracket 16. As non-limiting examples, these connectors 32 may be tie-wraps; metal tabs; metal clips; cable ties; rapid fasteners; strap wraps; mated gear wrap and ratchet; screws; nuts-and-bolts; drywall screws; or combinations thereof. The connectors 32 may be rigid or flexible. The connector 32 may be a tensioner 52, which creates a tension between the front bracket 16 and the back plate 28. The connector may be exclusively attached to one of the front bracket 16 or back plate 28. Alternately, an element may be attached to the back plate 28 and another attached to the front bracket 16, so that together the two elements form a connector 32 or tensioner 52. As a non-limiting example, a gear wrap 76 or gear strap may be attached to the back plate 28, and a ratchet 72 to the front bracket. When fed into the ratchets 72, the gear wrap 76 cinches the back plate 28 toward the front bracket 16.

It should be noted that a front bracket 16 and connector 32 could be designed all of one piece. As a non-limiting example, strips or extensions could continue from the bracket 16 toward the back plate 28, connect in some manner with the back plate 28, and then be bent, twisted, or cinched to create the necessary tension between the front bracket 16 and the back plate 28. Alternately, the back plate 28 and connector could be designed all of one piece, in a similar manner.

Figure 2:
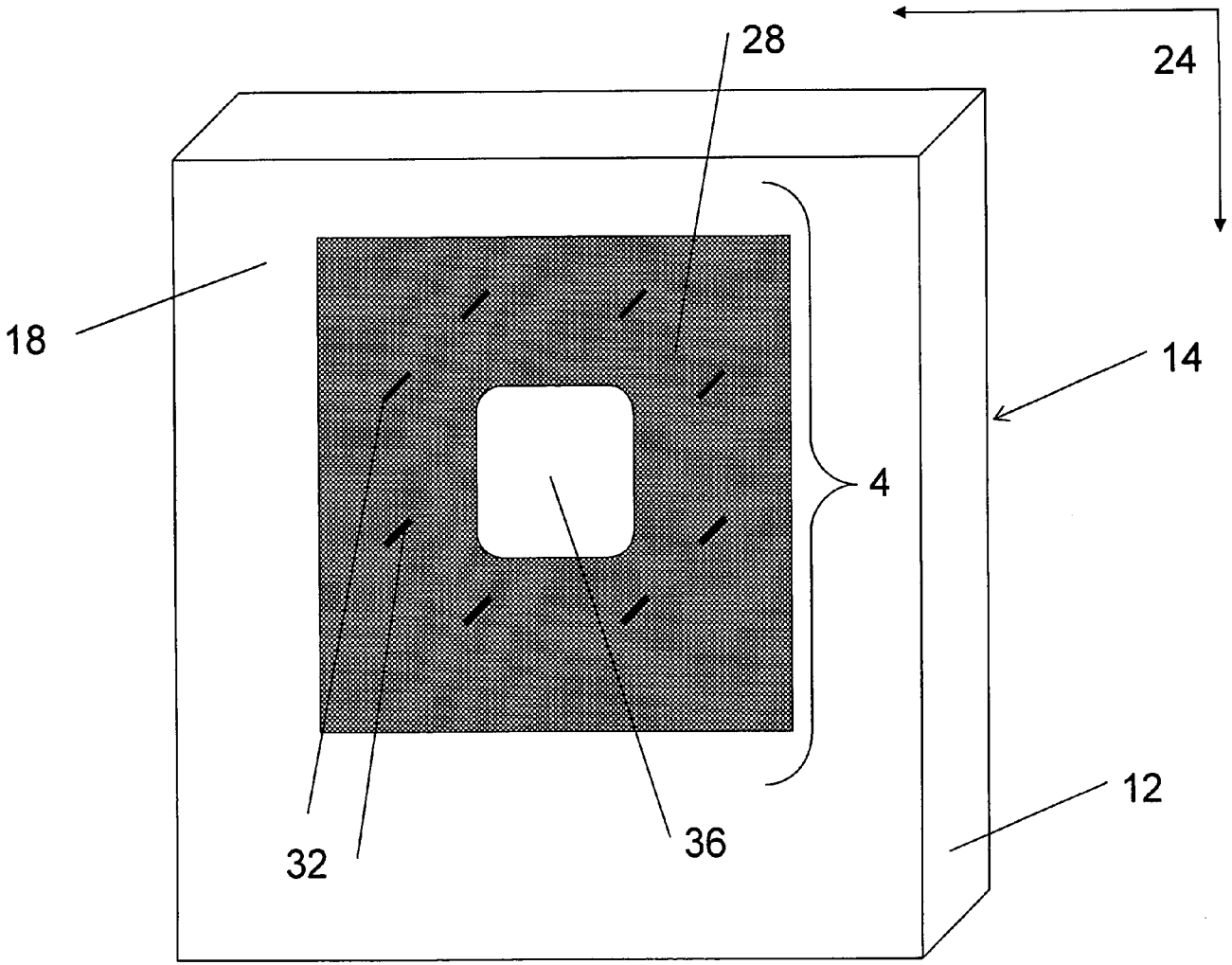
FIG. 2 shows a rear view of the mount of FIG. 1, with no component present.

Making reference to FIG. 2, which is a rear view of the embodiment of FIG. 1, a second surface 18 of the body 12 may be seen. A back plate 28, only partially visible in FIG. 1, may be fully seen here. The connectors 32 of FIG. 1 may also be seen here, protruding from the back plate 28. Again, the back plate 28 is open at its center 36.

Figure 3:
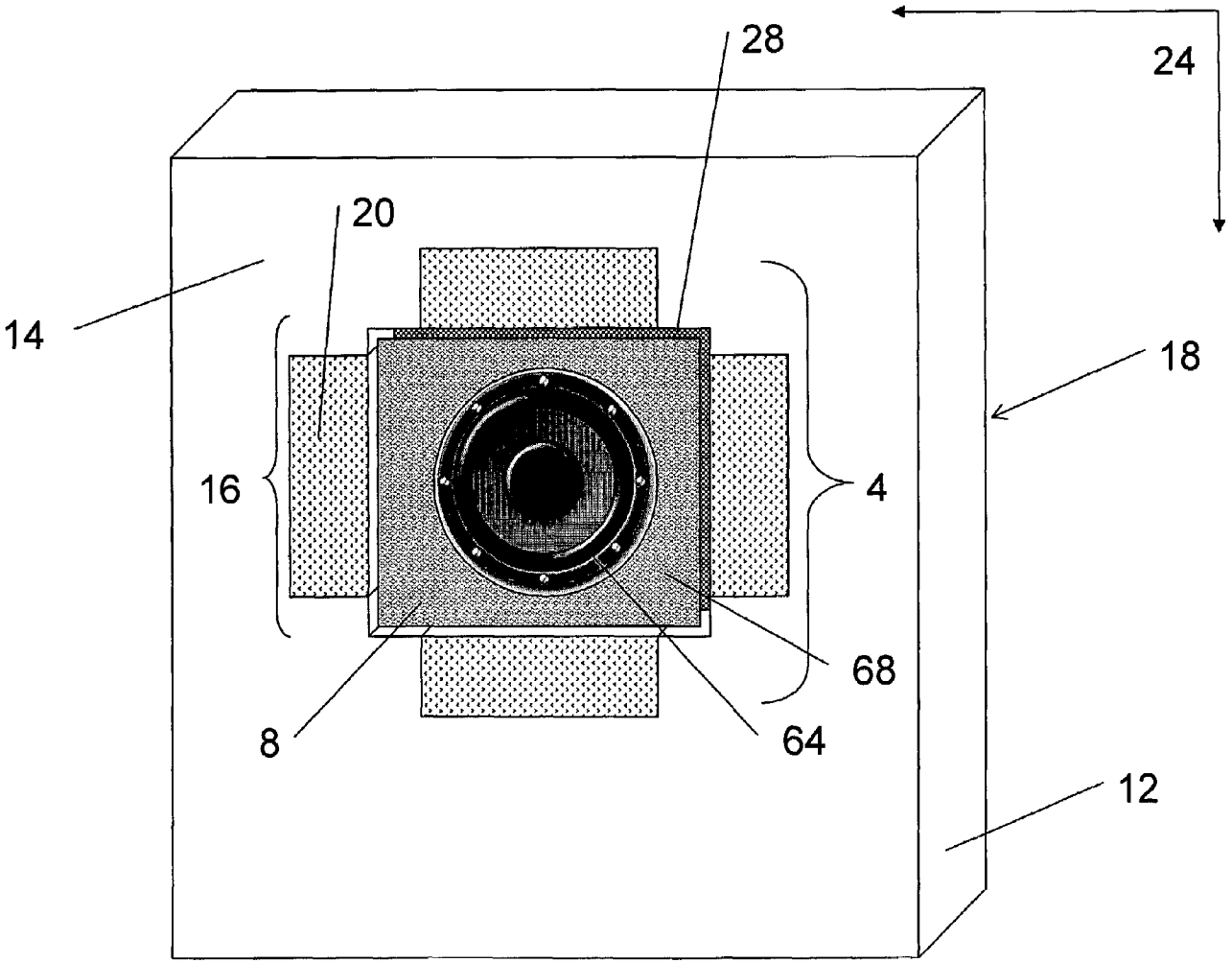
FIG. 3 shows a front view of the mount of FIG. 1, with a component present.

Making reference to FIG. 3, one may see the body 12 of FIG. 1, with a component 8 now attached to the back plate 28. The component 8 protrudes into the opening 6. In FIG. 3 the component 8 includes a speaker 64 and speakerboard 68, although these are nonlimiting examples. As further nonlimiting examples, the component 8 may also be an HVAC grill or a light, or any other component for which such a wall mount is sought. The component 8 may even be a composite component, where a portion of the component 8 is in the opening, while a portion protrudes outward.

Figure 4:
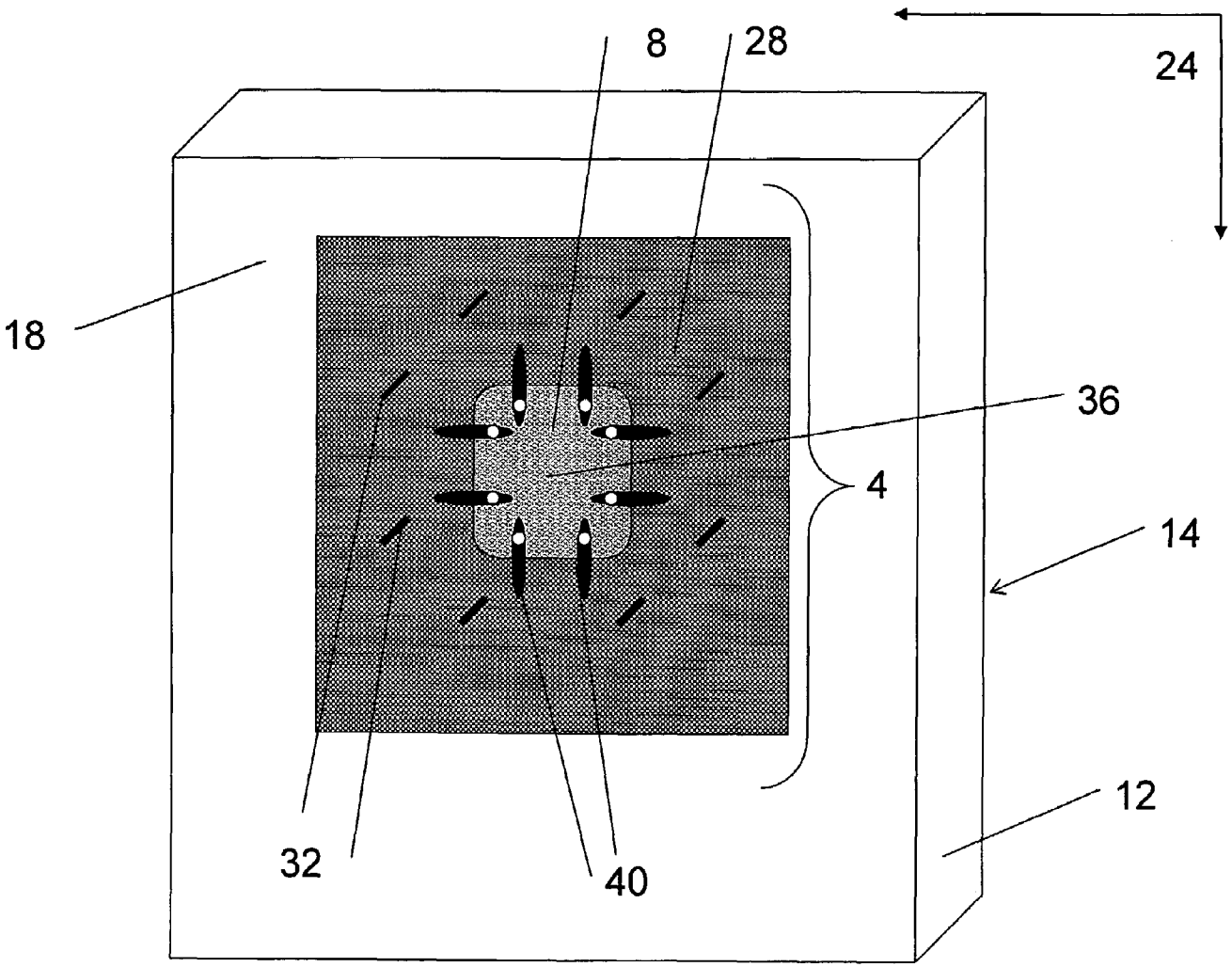
FIG. 4 shows a rear view of the mount of FIG. 1, with a component present.

Making reference to FIG. 4, it may be seen that the component 8 is secured to the back plate 28 through its open center 36. Shown as a non-limiting example are toggles 40, which turn out from the component 8 and attach to the back plate 28. It should be noted that these toggles 40 are a non-limiting example of attachment mechanisms for the component 8, and that many other attachment mechanisms are known which may be used to attach the component 8 to the back plate 28. The toggles 40 pinch the back plate 28 into the component 8. The back plate 28 is sufficiently shaped to prevent the component 8 from passing through the center 36 of the plate 28. Again, the connectors 32 may be seen. These connectors 32 keep the back plate 28 attached to the front brackets 20. Thus, the front bracket 20 is attached to the first surface 14 of the body 12, the back plate 28 is attached to the front bracket 20, and the component 8 is attached to the back plate 28.

Alternately, in another embodiment according to the present inventive disclosure, the component 8 may be attached to the front bracket 16, the back plate 28 may be attached to the second surface 18 of the body 12, and the front bracket 16 and the back plate 28 may be again secured with connectors 32.

The presently disclosed inventive subject matter has numerous benefits for component installation including ease of installation in new or existing structures, reduced costs for components and labor, quicker installation, more secure installation with better sound quality (when the component 8 is a speaker), and generally more aesthetically pleasing mounts which reveal little or none of their internal frame structure. Moreover, the presently disclosed inventive subject matter provides a mount in those locations or conditions where it is difficult to get good tolerance. Further, the presently disclosed inventive subject matter advantageously avoids the need for a front flange or frame, as the mount 4 may be self-supporting within the opening and achieve tension with the first surface 14 without large or aesthetically unpleasant flanges.

Figure 5:
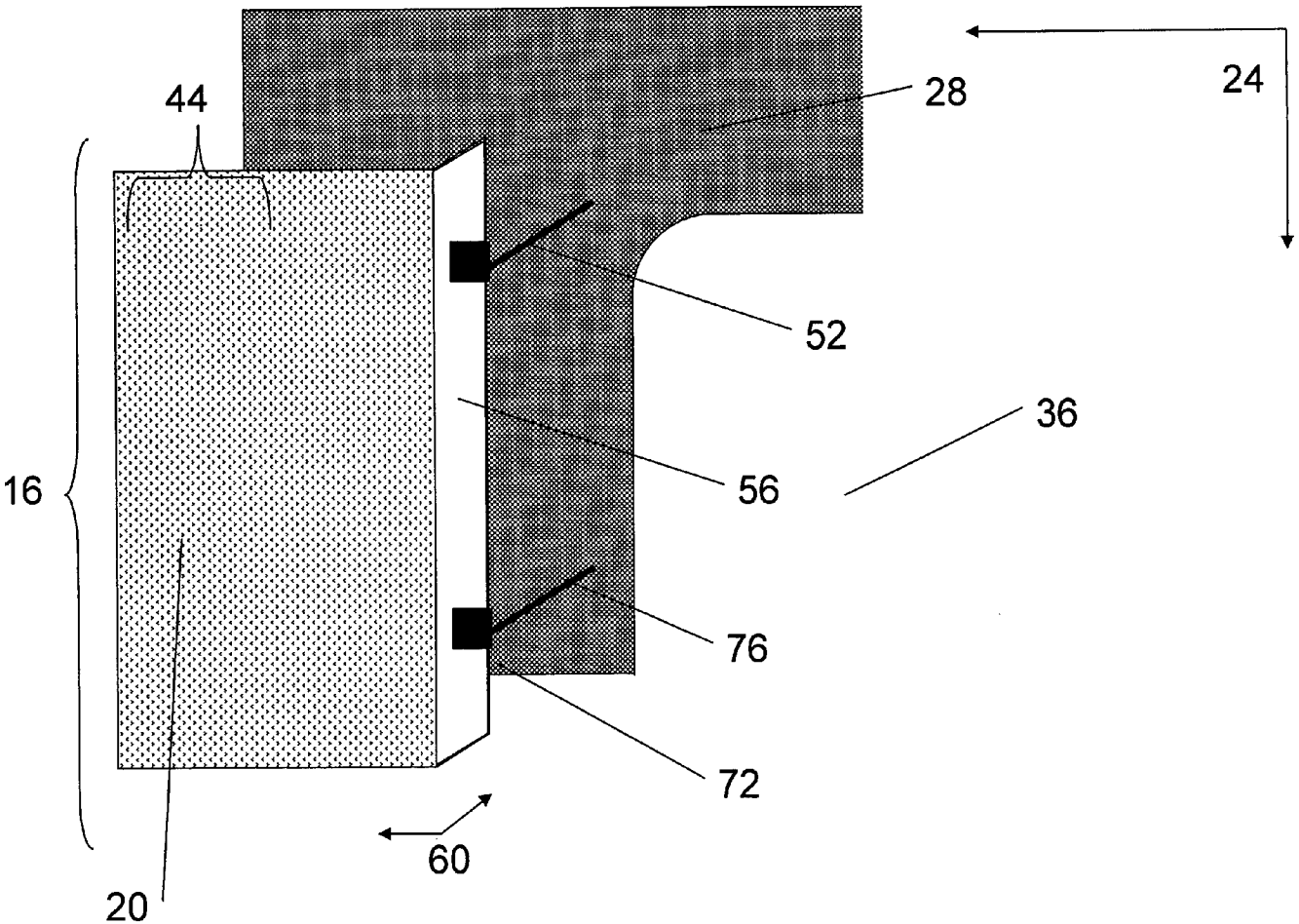
FIG. 5 shows a detail of a second embodiment of a mount according to the present application, with no component present.

FIG. 5 is a detailed view of the bracket 16 and back plate 28, showing the attachment wing 20 and inner wing 56. The planar body 12 is not shown. The inner wing 56, also visible in FIG. 1, is substantially perpendicular to the plane 24 of the body, and extends into the opening. The attachment wing 20 and inner wing 56 form an angle 60 of no more than 90 degrees, which may help to shore up weaknesses in the body 12 caused by the presence of the opening 6, and which may help to provide better attachment of the attachment wing 20 to the first surface 14 of the body 12. However, the wings can also form an angle of more than 90 degrees when advantageous, or when necessary for attachment at the surface.

Figure 6:
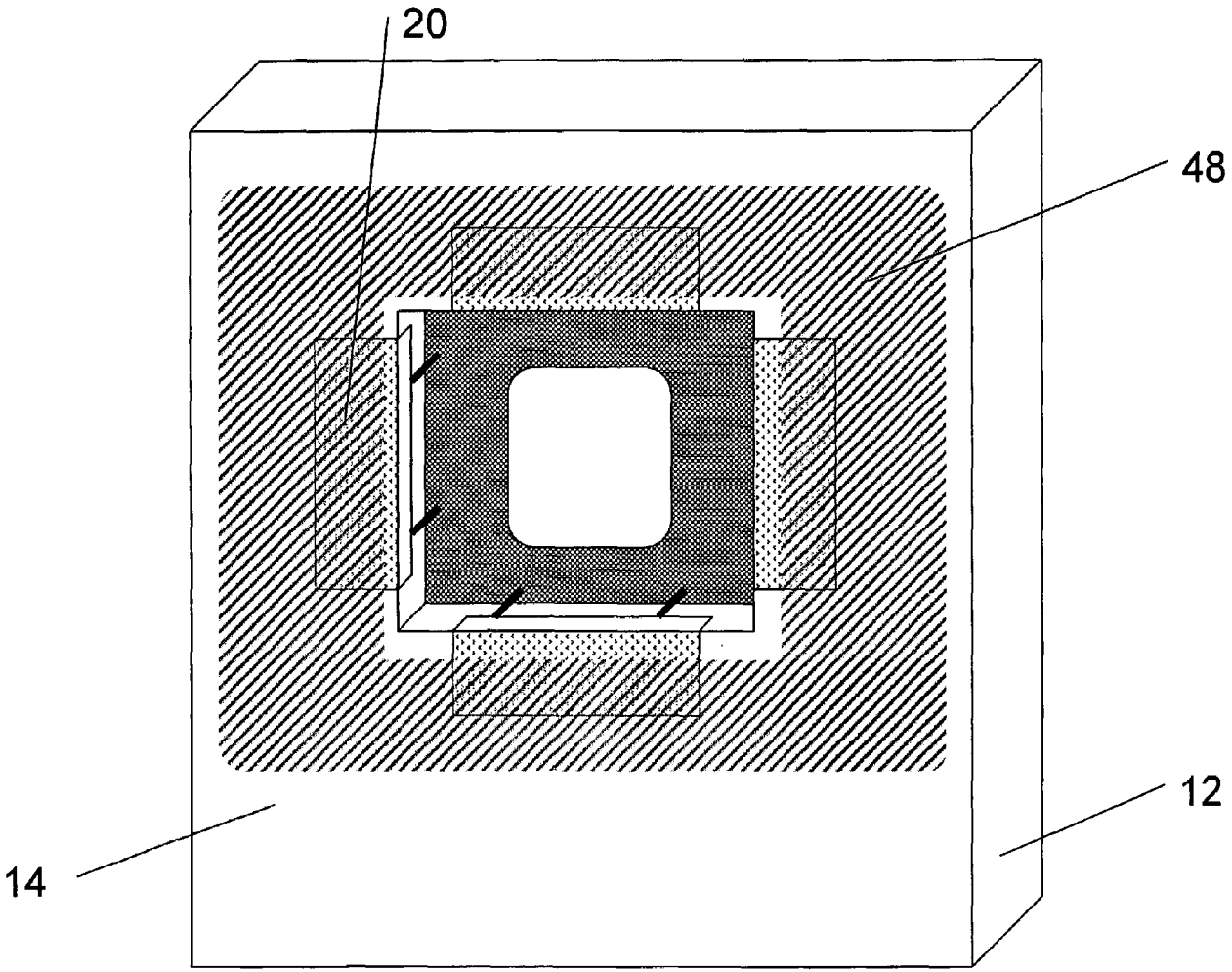
FIG. 6 shows a front view of a third embodiment of a mount according to the present application, with no component present.

FIG. 6 shows the mount of FIG. 1, where the attachment wings 20 have been further attached to the first surface 14 of the body 12 with an attachment compound 48.

Figure 7:
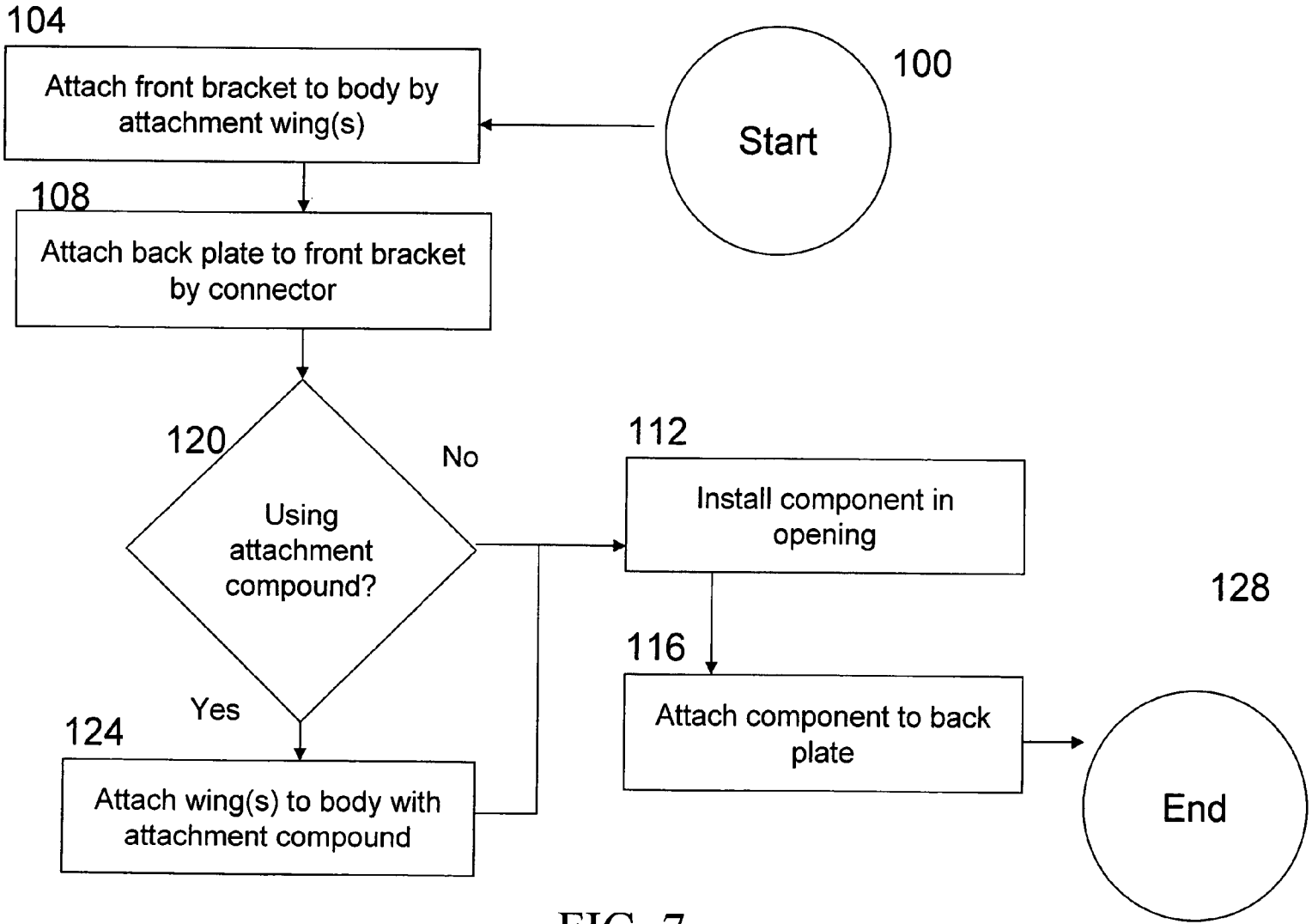
FIG. 7 charts a method for installing a component in an opening of a substantially planar body according to the present application.

FIG. 7 charts a method of installing a component in an opening of a substantially planar body. At the start 100, one attaches 104 a front bracket to a first surface of the body by at least one attachment wing substantially coplanar with the plane of the body. One then attaches 108 a back plate to the front bracket by at least one connector. If one desires 120 to use attachment compound, one may attach 124 one or more attachment wings to the first surface of the body with an attachment compound at this time, or at a short or long time thereafter. One may install 112 the component in the opening, and attach 116 the component to the plate at any time, up to the end 128.

It should be noted that this order of steps is a non-limiting example, and that other orders are indeed possible. For instance, the component may be attached to the back plate before the back plate is connected to the front bracket. Similarly, the wings may be attached to the first surface with attachment compound as the front bracket is attached to the body. The component need not be installed until long after the mount is in place. Other variations are available, and will be clear to those skilled in the art.

The above method may be achieved with a system for installing a component in an opening of a substantially planar body. The system may include means for attaching a front bracket to a first surface of the body such as compound and those others set forth herein, means for attaching a back plate to the front bracket such as tie wraps and those others set forth herein, and means for attaching the component to the back plate such as toggles and those others set forth herein. Every means described for attaching elements in this application may be used for all such attachment steps, whether from bracket to plate, plate to component, or bracket to surface.

Figure 8:
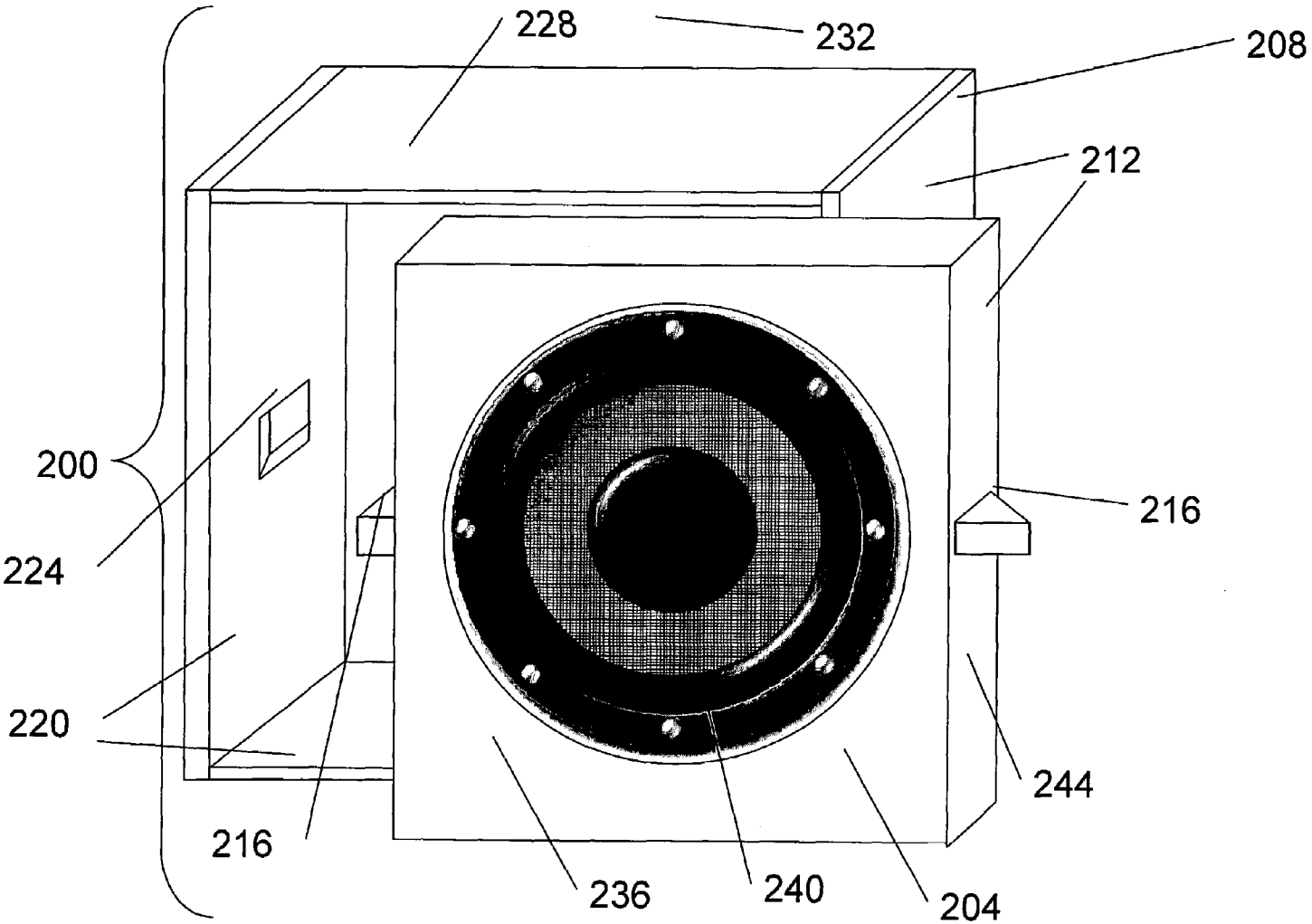
FIG. 8 shows a front view of a first embodiment of a component-and-frame combination according to the present application, with the component removed from the frame.

Making reference now to FIG. 8, the present inventive subject matter also relates to a component-and-frame combination 200. As shown, a component 204 may include a speaker 240 and speaker board 236, or may be any other component 204, including those components set forth above. The component 204 has a perimeter edge 212, with one or more protrusions 216 at a point on the perimeter edge 212. The perimeter edge 212 may be the edge 244 of the speaker board. As a non-limiting examples, these protrusions 216 may have a cross section like a triangle, as shown in FIG. 8. As further non-limiting examples, these protrusions 216 may also have a rectangular, teardrop or dimple shape, and may have one or more ridges or wedges; many shapes are advantageous to the purpose to be set forth more fully below. The protrusion 216 may be made of one or more materials, and may as non-limiting examples be rigid, partly flexible, or flexible.

Also shown in FIG. 8 is a frame 208, which as a non-limiting example is shown as a simple box frame. The frame 208 has an inside surface 220 facing a center of the framed space, and two indentations 224 of the inside surface 220 (only one visible) corresponding in position to the protrusions 216. The indentations 224 are shown as simple hollow box-shaped openings, but may be partly or fully closed on one or both sides, and may have a more complicated shape, including teardrop or dimple shaped.

It should be noted that while two protrusions 216 are shown, this is only by way of a non-limiting example, and that the present inventive subject matter would also accommodate a single protrusion 216 as described. In such a design, the component 204 may first attach to the frame 208 by a pivot, clip, or other means at one side, and then the protrusion 216 may be swung into position and snapped into the indentation 224. Alternately, multiple protrusions 216 could be utilized, and the component 8 could be aligned by the choice of protrusions 216, as discussed in detail below. Other single-indentation 224 insertion mechanisms will be clear to those skilled in the art.

Figure 9:
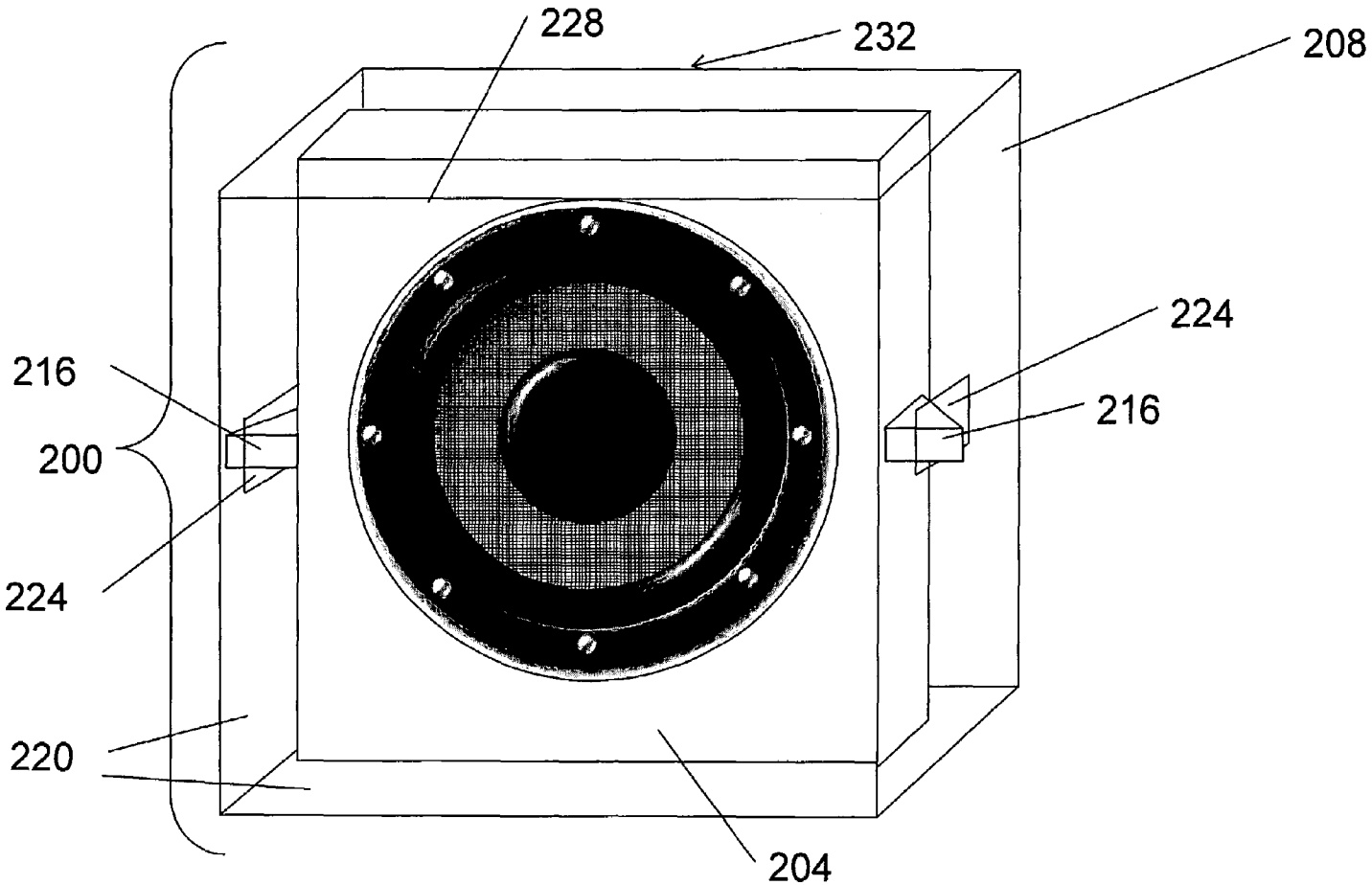
FIG. 9 shows a front view of the combination of FIG. 8, with the component installed in the frame.

When inserted, the combination may appear as in FIG. 9, where the frame 208 has been further simplified, and made transparent, to show the component seated within the frame 208. The protrusions 216 have been placed in the indentations 224, and extend slightly past the inside surface 220. Other protrusion-indentation combinations may have the protrusion 216 extend far beyond the inside surface 220, or not at all. The combination 200 of FIG. 9 is sturdy and secure. The combination 200 may be sold as assembled in FIG. 9 for a custom frameless mount according to the present disclosure, or any other component mount. The elements of the combination 200 may also be sold separately, for replacement or other purposes.

As can be seen, the protrusion 216 and the indentation 224 are shaped to allow the component to be inserted into the frame 208 from only a first side 228 of the frame 208, and to allow the component to be removed from the frame 208 from only a second side 232 of the frame 208. In this non-limiting example of FIGS. 8 and 9, the protrusions 216 flex forward during insertion from the first side 228, but cannot flex in the opposite direction for removal from the first side 228. Similarly, the protrusions 216 can flex forward during removal from the second side 232, but would not be capable of flexing for insertion from the second side 232. In this manner, the component 204 can be installed, removed, or replaced in the frame 208 without tools, screws, or other traditional fasteners. This has numerous benefits, including minimizing cost and labor, extending longevity of the mount 4 (where no screws or other attachment devices come loose), and improving quality and performance of the component in the body.

Figure 10:
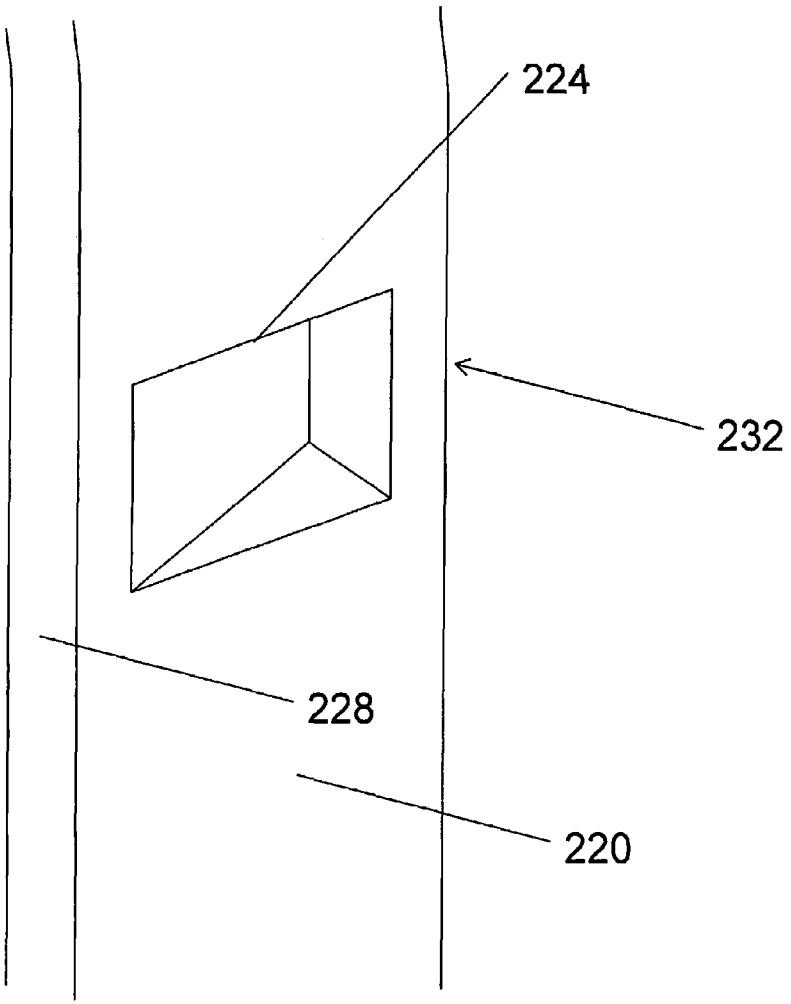
FIG. 10 shows a detail of a first embodiment of an indentation for a component-and-frame combination according to the present application.
Figure 11:
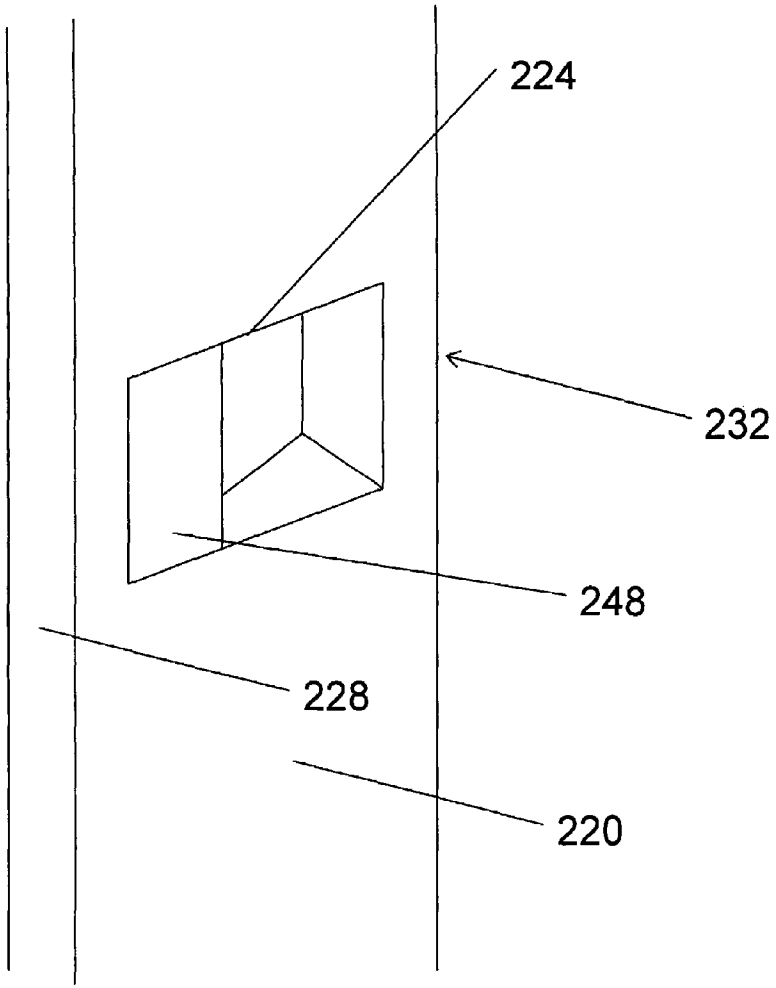
FIG. 11 shows a detail of a second embodiment of an indentation for a component-and-frame combination according to the present application.

Other designs for protrusions 216 and indentations 224 may be used, including those shown as non-limiting examples in FIG. 10 and FIG. 11. In FIG. 10, the indentation 224 is deeper at an end toward the second side 232 of the frame 208 than at an end toward the first side 228 of the frame 208, which serves to secure the protrusion 216 in one direction, while allowing insertion from the other direction. In FIG. 1, the indentation includes at least one ratchet 248, illustrated here as a simple blocking ratchet 248. The ratchet 248 prevents the component from being removed from the first side 228 of the frame 208. In this case, the indentation 224 is sufficiently shaped to prevent the component 204 from being inserted from the second side 232 of the frame 208, and from being removed from the first side 228 of the frame 208. However, many other indentation shapes will be obvious to one skilled in the art which are sufficiently shaped to prevent the component 204 from being inserted from the second side 232 of the frame 208, and from being removed from the first side 228 of the frame 208.

Figure 12:
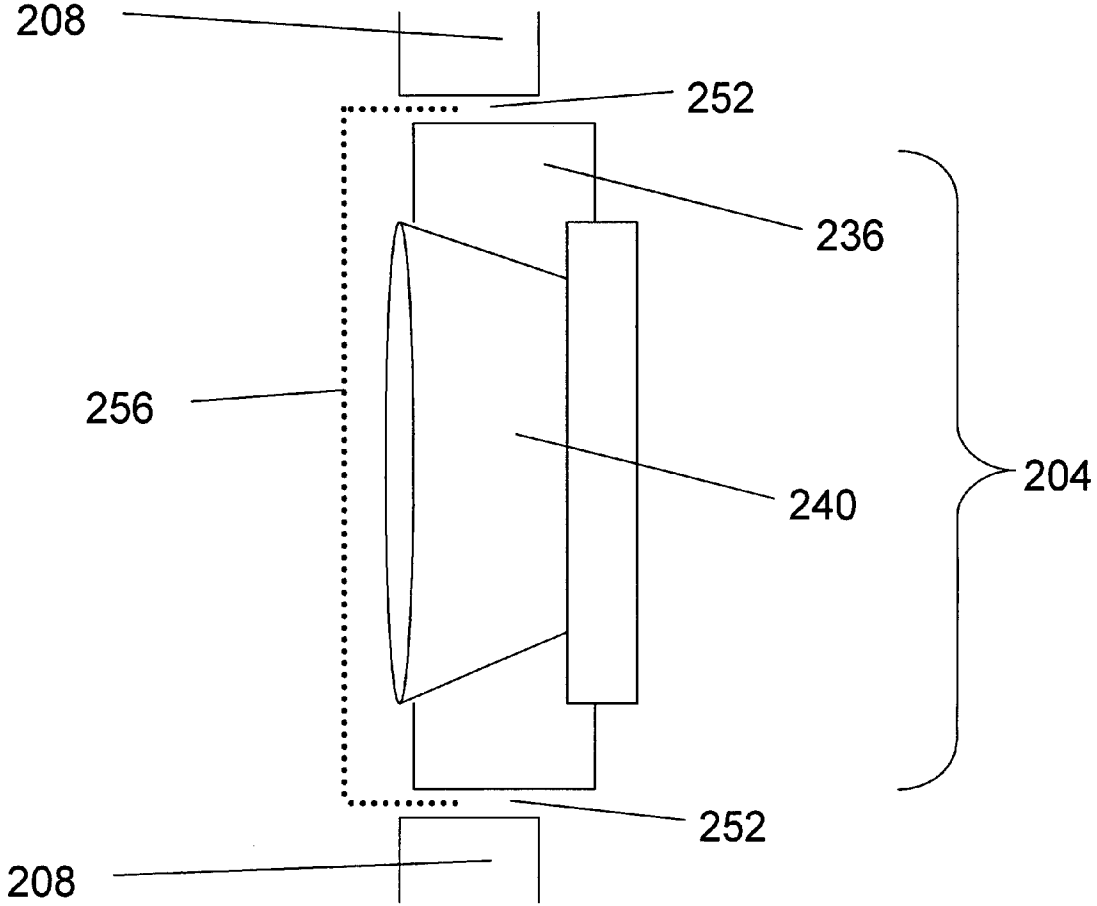
FIG. 12 shows a third embodiment of a component-and-frame combination according to the present application.

As shown in FIG. 12, the combination 200 may include not only a component 204 (here shown having a speaker 240 and a board 236) and a frame 208, but also a channel 252 between the component 204 and the frame 208, and a grill 256 or other element secured within the channel 252. Other elements which may be secured within the channel, or to the component or frame 208, include decorative trim and cabling, ports, or other devices for electronic communication with the component. Just as the channel 252 advantageously serves as a built in spacer, so too can the protrusions 216 and indentations 224 be advantageously placed on the component 204 and frame 208 to provide built in spacers where they are most needed, for alignment of the component 204 or for other elements secured between the component 204 and frame 208.

An important application of the present inventive subject matter is directed to proper alignment of a speaker or other component 204. While an embodiment with only one or two protrusions may be aligned in only one position, an embodiment with multiple protrusions or multiple protrusions, or both, is also envisioned. The multiple protrusions may be aligned vertically or horizontally or both. Such an embodiment would "snap" into place at multiple depths and even at multiple angles. As a non-limiting example, one could install such a component 204 from the front, and then make minute adjustments to the component depth by continuing to "snap" the component into greater depths toward the back, until the component stops at an aligned depth. The component could then be shored into place from behind so that no more adjustment is possible.

Although only a component 200 with protrusions 216, and a frame 208 with indentations 224, are shown, it should be noted that the present inventive subject matter is not limited to this combination. Also possible are components 200 with indentations 224 and frames 208 with protrusions 216, or frames 208 and components 200 with interleaved combinations of indentations 224 and protrusions 216. Such indentations 224 and protrusions 216 may be advantageously placed to allow for a more secure mount, easier insertion and removal, or both. Although only one and two protrusions 216 have been discussed, it should be noted that embodiments having many more protrusions 216 and indentations 224 are envisioned and may be desired.

Figure 13:
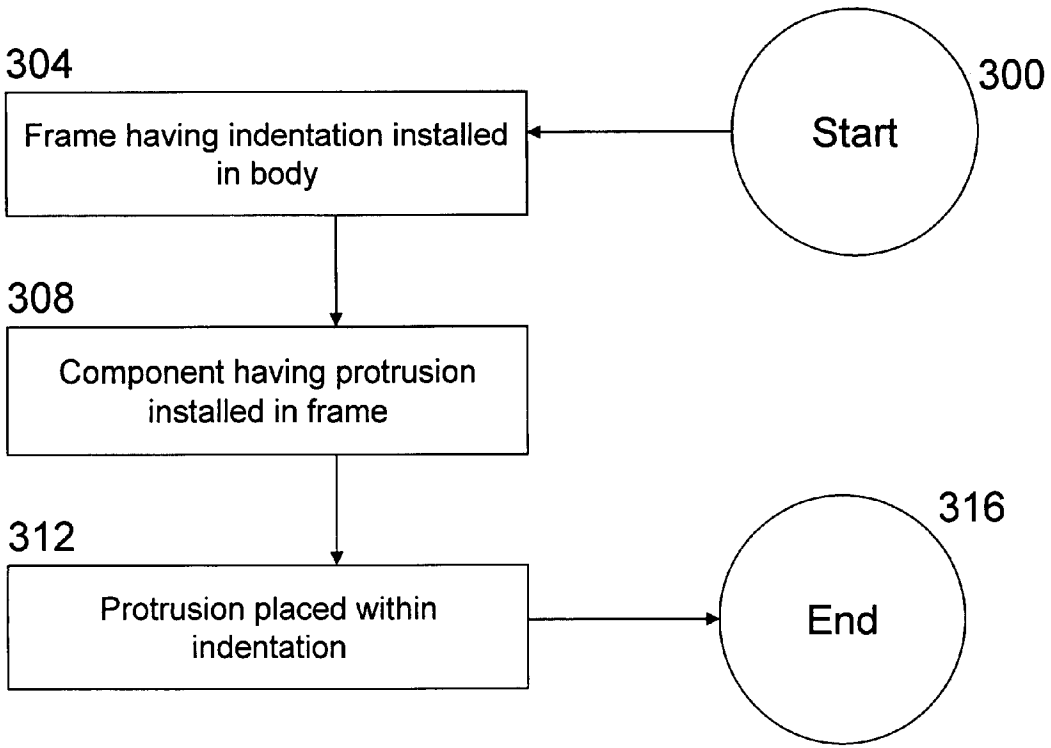
FIG. 13 charts a method for installing a component-and-frame combination according to the present application.

FIG. 13 charts a method for installing a component-and-frame combination. At the start 300, a frame having an indentation is installed 304 in a body. Then, a component having a protrusion is installed 308 in a frame. Then, at the end 316, a protrusion is placed 312 within the indentation. It should be noted that this order of steps is a non-limiting example, and that other orders are indeed possible, and will be clear to those skilled in the art.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. For example, one or more elements can be rearranged and/or combined, or additional elements may be added. Thus, the present invention is not intended to be limited to the embodiments shown herein but is to be accorded the widest scope consistent with the principles and novel features disclosed herein.

Having described the invention in detail and by reference to the embodiments thereof, it will be apparent that modifications and variations are possible, including the addition of elements or the rearrangement or combination or one or more elements, without departing from the scope of the invention which is defined in the appended claims.

What is claimed is:

1. A mount for mounting a component within an opening of a substantially planar body, the mount comprising:

a front bracket configured to rest at an opening of a substantially planar body and having at least one attachment wing for attachment to a first surface of the body, in a configuration substantially coplanar with the plane of the body;

a back plate configured to be secured to a component and to rest at a second surface of the body opposite the first surface of the body; and at least one connector connecting the front bracket to the back plate, wherein the front bracket, the back plate, and the connector are configured to connect through an opening of the body, wherein the front bracket and the back plate are configured to press against said opposite first and second surfaces of the body when connected, and wherein the mount, when assembled, is configured to support the component within the opening of the body.

2. The mount of claim 1, wherein said back plate is open at its center for securing the component through the center, and said back plate is sufficiently shaped to prevent the component from passing through the center.

3. The mount of claim 1, wherein said attachment wing is perforated, and wherein the mount includes an attachment compound for attaching the attachment wing to the first surface of the substantially planar body.

4. The mount of claim 1, wherein, said connector is a tensioner which creates a tension between said front bracket and said back plate.

5. The mount of claim 1, wherein said front bracket further comprises at least one inner wing substantially perpendicular to the attachment wing and configured to extend into the opening of the body, and wherein said attachment wing and said inner wing form an angle of no more than 90 degrees.

6. The mount of claim 1, wherein the back plate is open at its center for securing a speaker through the center, and said back plate is sufficiently shaped to prevent the speaker and a speaker board from passing through the center.

7. The mount of claim 1, wherein said substantially planar body is selected from the group consisting essentially of: door, wall, ceiling; and said substantially planar body comprises at least one material selected from the group consisting essentially of: drywall, plaster, sheet rock, wood, wood paneling, wallboard, metal, plastic, combinations thereof.

8. The mount of claim 1, wherein said connector is selected from the group consisting essentially of: tie-wraps; metal tabs; metal clips; cable ties; rapid fasteners; strap wraps; mated gear wrap and ratchet; screw; nut-and-bolt; drywall screw, combinations thereof.

9. A method of installing a component in the mount recited in claim 1, the method comprising:

attaching a front bracket to a first surface of a substantially planar body by at least one attachment wing substantially coplanar with the plane of the body;

attaching a back plate to said front bracket through an opening of the body by at least one connector;

installing a component in the opening; and attaching the component to said back plate.

10. The method of claim 9, the method further comprising:

attaching said attachment wing to the first surface with an attachment compound.

* * * * *